United States Patent [19]

Hofer et al.

[11] 4,177,775

[45] Dec. 11, 1979

[54] FUEL INJECTION PUMP

[75] Inventors: Gerald Höfer, Flacht; Karl Konrath, Ludwigsburg; Manfred Schwarz, Gerlingen; Willi Müller, Sulz, all of Fed. Rep. of Germany

[73] Assignee: Robert Bosch GmbH, Stuttgart, Fed. Rep. of Germany

[21] Appl. No.: 916,171

[22] Filed: Jun. 16, 1978

[30] Foreign Application Priority Data

Jul. 1, 1977 [DE] Fed. Rep. of Germany ..... 2729807

[51] Int. Cl.[2] ..... F02M 39/00; F04B 19/02

[52] U.S. Cl. ..... 123/139 AP; 123/139 AQ; 123/139 AY; 417/462

[58] Field of Search ..... 123/139 AP, 139 AQ, 123/139 AY, 139 AL; 417/462

[56] References Cited

U.S. PATENT DOCUMENTS

| | | | |
|---|---|---|---|
| 3,308,799 | 3/1967 | Bessiere | 123/139 AQ |
| 3,869,226 | 3/1975 | Sosnowski | 417/462 |
| 3,906,916 | 9/1975 | Laufer | 123/139 AQ |
| 4,033,310 | 7/1977 | Nicolls | 123/139 AP |
| 4,050,437 | 9/1977 | Hollett et al. | 417/462 |
| 4,098,249 | 7/1978 | Mowbray | 417/462 |

FOREIGN PATENT DOCUMENTS

| | | | |
|---|---|---|---|
| 1234090 | 2/1967 | Fed. Rep. of Germany | 123/139 AP |

*Primary Examiner*—Charles J. Myhre
*Assistant Examiner*—P. S. Lall
*Attorney, Agent, or Firm*—Edwin E. Greigg

[57] ABSTRACT

A fuel injection pump in which the onset of fuel injection can be varied by way of a device operating in dependence on speed in a conventional manner by turning the roller ring which cooperates with a cam plate which in turn is connected with the pump and distributor piston. In accordance with the present invention the angle of twist of the roller ring is limited by a stop which engages this ring.

14 Claims, 5 Drawing Figures

FUEL INJECTION PUMP

BACKGROUND OF THE INVENTION

The invention relates to a fuel injection pump for internal combustion engines provided with a cam drive mechanism which causes a conveying motion of at least one pump piston. A fuel injection pump of the type to which the invention is directed is shown in U.S. Pat. No. 3,906,916. The cam drive mechanism further comprises a roller ring which is rotatable by means of a device which operates in dependence on rpm for the purpose of adjusting the onset of injection. In a conventional fuel injection pump, the instant of onset of injection of the hydraulically operating injection timing mechanism is set to "early" during start-up. At a higher speed, the onset of injection is then automatically shifted to "later" and then is readjusted to "early" during an increase in the number of revolutions. In another conventional device of this type, the starting position of the operating piston of the injection timing mechanism is shifted to "early " by means of a stop, as long as the engine is cold. While, in the former case, a relatively expensive hydraulic control must be provided, the second case involves the problem of sealing the stop which projects into the pressure chamber of the servo piston.

OBJECT AND SUMMARY OF THE INVENTION

The fuel injection pump of this invention with the characterizing features of the main claim has distinct advantages over the prior art, for since there is only a low pressure ambient in the cam drive chamber, no sealing problem is encountered; the installation position of the device which adjusts the stop can take place quite arbitrarily, which is of tremendous importance in view of the constantly increasing space limitation for installation of parts in passenger vehicles; the lever paths and forces are smaller, whereby the control feature becomes more versatile and economical; and, also, it is easier to adapt the stop position to a required, for example square, adjustment rule, for instance with an increasing temperature, a smaller displacement of the stop per temperature change. Additionally, such an early adjustment is desirable only in some engines so that the relative disadvantage of tampering with the mass-produced injection timing mechanism is unnecessary; rather, only the recess is provided in the ring in the mass-produced arrangement and, where necessary, the device of this invention can be installed in the desired engines, even attached thereto at a later date. This satisfies the need for improving the degree of automation in injection pumps by means of building blocks to thereby achieve with simple means the increasing demand for a variety or different types.

The invention will be better understood as well as further objects and advantages thereof become more apparent from the ensuing detailed description of a preferred embodiment taken in conjunction with the drawings.

DESCRIPTION OF THE PREFERRED EMBODIMENT

As is known, the injection takes place in diesel engines when the piston of the engine is in the zone of its top dead center, TDC. The instant of onset of the injection lies, depending on the rpm, just before, at, or just after TDC, in general, coming earlier at higher rpm than at lower rpm. Whereas the time required by the fuel to pass between the pump and the nozzle remains practically constant, independently of the rpm, the time required between pump feed and combustion in the engine varies in correspondence with the rpm. This change in the time relationship is compensated for by the injection timing mechanism, for which a large portion of its operating energy is consumed. However, the remainder of its operating energy serves, depending on the requirement existing on the engine, for improving the fuel consumption, the power, the engine noise, and/or the exhaust gases. As is known, the ignition delay of a diesel internal combustion engine is dependent on the temperature, that is, not only on the fuel temperature, but, also on the temperature of the internal combustion engine in the form of the cylinder wall temperature, the injection temperature, etc. To equalize this ignition delay, it is advantageous in the case of cold internal combustion engines to place the onset of injection at an earlier point in time in case of low rpm; in the upper rpm range, blue smoke and noisy operation have a lesser effect. However, in case of a warm internal combustion engine, this would lead to a rough engine and the internal combustion engine would be noisy. An adjustment toward "early" is also advantageous, as is known, during starting, in order to rapidly attain the desired rpm of the internal combustion engine. Another feature of the cold internal combustion engine is that it develops less blue smoke in case of an early instant of the beginning of injection than at a late point in time.

Figure 1:
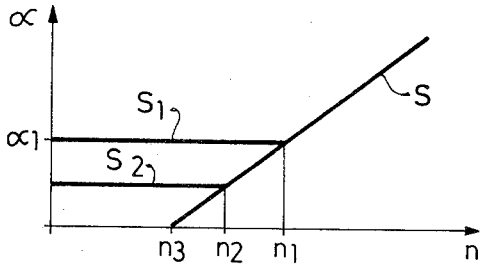
FIG. 1 is a diagram showing the amount of adjustment according to the rpm.

In the diagram shown in FIG. 1, the injection adjustment angle $\alpha$ is plotted over the ordinate, and the speed n is plotted over the abscissa. The injection adjustment angle $\alpha$ is understood to mean the relative torsional shift between the drive shaft and the piston drive mechanism of the injection pump, as will be described in greater detail hereinbelow; n represents the rpm of the pump and the corresponding engine rpm, respectively. The curve S corresponds to the injection adjustment at normal operating temperature. In accordance with this curve S, each rpm n is associated with a specific angle $\alpha$ of adjustment. The higher the rpm n, the larger the angle $\alpha$ of adjustment, and the earlier the instant of onset of injection. According to the invention, during start-up and at lower rpm, as well as when the engine is cold, an adjustment angle $\alpha_1$ in the direction toward "early" is determined by a stop to satisfy the above-mentioned requirements. Only when the rpm has risen above a rpm $n_1$ is there a further adjustment of $\alpha$ in the direction "early". Here, $n_1$ can readily attain the order of magnitude of half the maximum rpm. Thus, as long as the rpms are smaller than $n_1$, a minimum early adjustment remains set in accordance with curves $S_1$. As soon as the engine has "warmed up", the stop is rendered inoperative, and the adjustment takes place also at rpms which are lower than $n_1$, in accordance with curve S.

Figure 2:
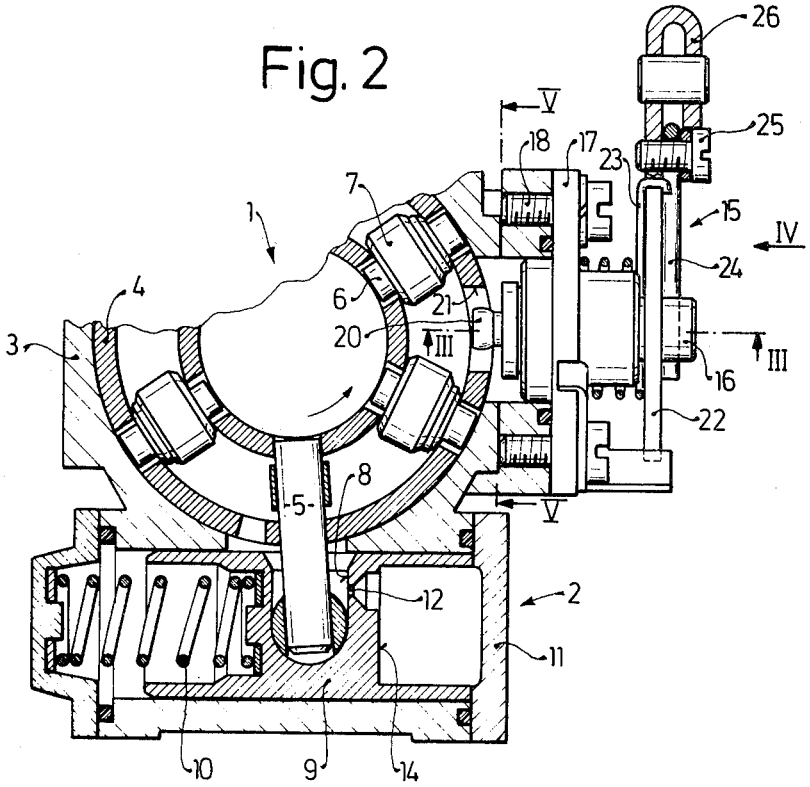
FIGS. 2, 3, 4 and 5 are cross-sectional views of the embodiment of this invention.

FIG. 2 shows a partial sectional view of the fuel injection pump of this invention in the zone of the cam drive mechanism 1 which is engaged by an injection timing mechanism 2. In case of the distributor injection pumps, one of which has been selected here as an example, two types of cam drive mechanisms are essentially utilized. In one type, the rollers are connected with the pump piston and the cams are arranged at the ring guided by the housing. In the other type, as chosen here for the example, the rollers are arranged at the ring guided by the housing and the cams are arranged in conjunction with the pump piston by way of a cam disc. In either case, the pump piston is driven individually, whereas rollers and cams cooperate for the pumping operation; depending on the type of drive mechanism, the rollers or cams can be turned relative to one another by way of the ring guided by the housing, by means of the injection timing mechanism.

A roller ring 4 is guided in a housing 3 of the fuel injection pump of the invention and this roller ring is connected to the injection timing mechanism 2 by means of an adjusting pin 5. By way of axles 6, rollers 7 are supported at the roller ring 4, as shown in an elevational view. An end cam disc, not shown, which is connected to the pump piston and distributor piston then runs on these rollers. The pump piston and the end cam disc rotate in the direction indicated by the arrow. Thus, as soon as the roller ring 4 has been turned opposite to this direction of rotation by only a few angular degrees, the onset of the feeding process by the pump piston will begin at an earlier point in time. If the amount injected is determined by regulating the end of the feeding step, rather than by regulating the beginning of the feeding step, such an adjustment consequently also means a change in the onset of injection into the internal combustion engine.

The adjusting pin 5 of the cam drive mechanism 1 engages an entrainment recess 8 of an adjusting piston 9, which can be displaced against the force of a restoring spring 10 by a hydraulic pressure which increases with the speed and in most cases is additionally controlled in dependence on the load. The farther the piston 9 is shifted toward the spring 10, the earlier thus is the onset of injection. In the illustrated starting position, the adjusting piston 9 is in contact with the sealing lid 11 which serves as the stop. The hydraulic pressure is produced for adjustment purposes in a conventional manner by a feed pump, not shown, and this is integral with the housing 3 of the fuel injection pump and is driven at the speed of the latter. By way of a pressure control valve, the initial pressure of this feed pump is then controlled so that it varies in proportion to the rpm. In this embodiment of the invention the feed pump conveys fuel into the housing 3, which passes via corresponding supply bores to the operating chamber of the pump. In other embodiments, in turn, the space of the cam drive mechanism 1 is in communication with the intake side of the feed pump and thus is under low pressure. However, in this embodiment, the fuel flows into the entraining recess 8 which also houses the adjusting pin 5, via a throttle bore 12, to the end face 14 of the adjusting piston. At a sufficiently high conveying pressure, the adjusting piston 9 is then shifted against the force of the spring 10, whereby the instant of onset of injection is adjusted to "early" as described above.

Figure 3:
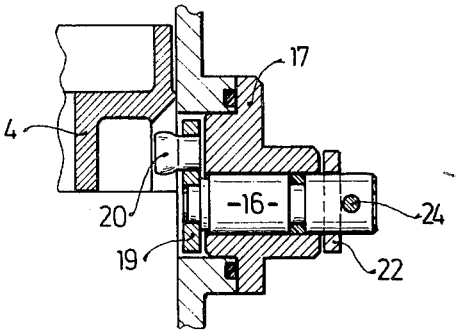
Figure 4:
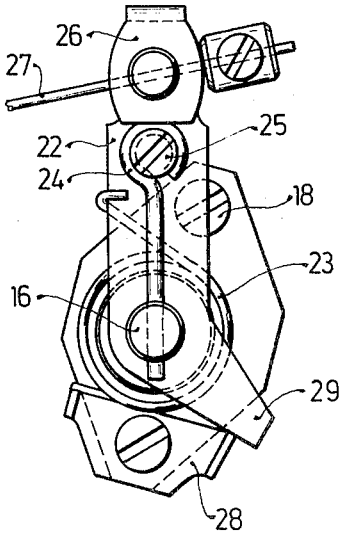
Figure 5:
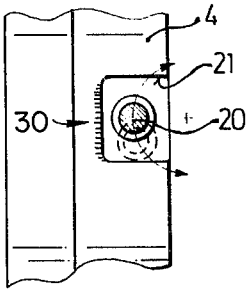

To avoid an adjustment toward "late" in case of a cold engine and start-up as described above, the fuel injection pump is equipped with a device 15 having a stop for the cam ring 4. This device is shown, in FIG. 2, in a lateral view, to illustrate how this device, once a cover is removed, can simply be attached by screws to a pump. In FIG. 3, this device is shown in a section along line III of FIG. 2. In FIG. 4, the same device is shown in a top view according to IV in FIG. 2. FIG. 5 shows a partial lateral view of the cam ring 4 at the point of engagement of the stop.

As illustrated in the figures, a pivot pin 16 is rotatably mounted in a cover 17 with the cover 17 being fixedly joined to the housing 3 by means of screws 18. A plate 19 is attached to the pivot pin 16 and this plate carries an eccentrically arranged stop 20. This stop 20 engages a recess 21 of the roller ring, the recess 21 being provided with indicia markings 30 for adjustment of the ring 4. When the pivot pin 16 is turned, the stop 20 traverses the circular path illustrated by arrows in FIG. 5. Therefore, depending on the rotary position of the pivot pin 16, a variable turning angle range is available to the roller ring 4. A twisting of the roller ring 4 in opposition to the direction of rotation of the pump piston depicted in FIG. 2 results in an adjustment of the onset of injection toward "early". In case of a cold engine, the stop 20 is displaced, in accordance with the invention, so that it adjusts the roller ring 4 in opposition to the direction of rotation of the pump piston, so that the stop 20 comes into direct contact with the wall of the recess 21 for this displacement. By means of this displacement, the adjusting piston 9 of the injection timing mechanism is lifted off the sealing lid 11.

On the side of the adjusting pin 16 which faces away from plate 19 (see FIG. 3), an adjusting lever 22 is arranged for rotation. As shown best in FIGS. 2 and 3, a restoring spring 23 engages lever 22. Beyond this adjusting lever 22 the adjusting pin 16 is provided with a transverse bore into which is inserted the free end of a flexible bent rod 24 which serves as the transmitting means for the desired rotational movement. This bent rod is firmly connected by means of a screw 25 with the adjusting lever 22 at the end of the rod facing away from the pivot pin 16. Thus, if the adjusting lever 22 is pivoted, the pivot pin 16 is entrained by way of the bent rod. If, on the other hand, the stop 20 is exposed to shocks occurring during the pump conveying operation, such shocks are elastically absorbed by the bending rod 24.

The adjusting lever 22 has a head 26 formed by an elbow of the lever; a Bowden cable 27 engages this head 26. This Bowden cable can either lead to the so-called choke in the driver's cab of the vehicle, but it can also lead to a thermostatic element heated by the cooling water of the engine or by a heating coil. In the examples, the lever 22 assumes a position for normal operation. In contrast thereto, if the engine is cold, the lever pivots toward the left in FIG. 4, the stop 20 thereby assuming the position shown in dashed lines in FIG. 5, and for this position, as described above, the stop correspondingly turns the roller ring 4. The starting position of the lever 22 shown in FIG. 4 is determined by an abutment 28 against which the lever is pulled with an arm 29 by means of the restoring spring 23. Thus, when the engine is cold, the lever is withdrawn from the abutment 28 either by hand or by the thermostat, but, with an increase in engine temperature or by adjustment of the choke by the driver, the lever is pulled by the spring 23 back to the abutment 28. The abutment 28 is also fixedly clamped in position by means of the one screw 18 and can be adjusted as desired.

The foregoing relates to a preferred exemplary embodiment of the invention, it being understood that other embodiments and variants thereof are possible within the spirit and scope of the invention, the latter being defined by the appended claims.

What is claimed and desired to be secured by Letters Patent of the United States is:

1. A fuel injection pump for internal combustion engines provided with a cam drive mechanism arranged to actuate at least one pump piston, said cam drive mechanism comprising a ring stationarily mounted in the pump housing and being rotatable by means of a device operating in dependence on the speed, and adpated to adjust the onset of injection, comprising a stop means arranged to limit the twisting angle ($\alpha$) of said ring and further being adjustable by way of another device which engages into at least one corresponding recess of said ring.

2. A fuel injection pump as claimed in claim 1, wherein the rotation of said ring oriented into the direction "late" can be limited by way of said other device by means of said stop means to accommodate cold starting of an engine.

3. A fuel injection pump as claimed in claim 1, wherein said other adjusting device is operated by a Bowden cable.

4. A fuel injection pump as claimed in claim 2, wherein said other adjusting device is operated by a Bowden cable.

5. A fuel injection pump as claimed in claim 1, wherein said other adjusting device includes a thermostat element.

6. A fuel injection pump as claimed in claim 5, wherein said thermostat is electrically heated.

7. A fuel injection pump as claimed in claim 5, wherein said thermostat element is operated by coolant of the internal combustion engine.

8. A fuel injection pump as claimed in claim 1, wherein said recess and the stop means are arranged radially with respect to said ring.

9. A fuel injection pump according to claim 8, wherein said stop means includes a pin member attached axially and eccentrically to a pivot pin mounted in said pump housing and operable by a lever means against a restoring spring.

10. A fuel injection pump as claimed in claim 9, wherein said ring further includes a periphery and said recess extends therethrough, said recess further arranged to include indicia markings for adjustment of said ring.

11. A fuel injection pump as claimed in claim 1, wherein said other adjusting device further includes an elastic intermediate member.

12. A fuel injection pump according to claim 11, wherein said elastic member includes an entraining spring that is disposed between said lever means and said pivot pin.

13. A fuel injection pump as claimed in claim 12, wherein said lever means includes a bore arranged to receive said pivot pin, said pivot pin further being rotatable by means of an elastic bent rod which is associated therewith, said elastic bent rod including a remote portion which cooperates with said lever.

14. A fuel injection pump as claimed in claim 1, wherein another recess is provided in said ring for adjustment and selective engagement of said stop means.

* * * * *